US007717095B2

(12) United States Patent
Liu

(10) Patent No.: US 7,717,095 B2
(45) Date of Patent: May 18, 2010

(54) EVAPORATIVE EMISSIONS PURGE CONTROL

(75) Inventor: Ching-Po Liu, Grand Blanc, MI (US)

(73) Assignee: GM Global Technology Operations, Inc.

( * ) Notice: Subject to any disclaimer, the term of this patent is extended or adjusted under 35 U.S.C. 154(b) by 248 days.

(21) Appl. No.: 12/021,575

(22) Filed: Jan. 29, 2008

(65) Prior Publication Data

US 2009/0138173 A1 May 28, 2009

Related U.S. Application Data

(60) Provisional application No. 60/990,465, filed on Nov. 27, 2007.

(51) Int. Cl.
*F02M 33/02* (2006.01)
*F02M 33/04* (2006.01)

(52) U.S. Cl. ..... 123/520

(58) Field of Classification Search ..... 123/520, 123/519, 518, 516, 480, 198 D; 137/587–589, 137/43, 493
See application file for complete search history.

(56) References Cited

U.S. PATENT DOCUMENTS 5,060,621 A 10/1991 Cook
6,152,116 A * 11/2000 Duty ..... 123/520

OTHER PUBLICATIONS

U.S. Appl. No. 11/668,888, filed Jan. 30, 2007, Paul E. Reinke.

* cited by examiner

*Primary Examiner*—Mahmoud Gimie

(57) ABSTRACT

A fuel vapor control module for a vehicle comprises a refill diagnostic module, a refill volume calculation module, a canister loading module, and a purge adjustment module. The refill diagnostic module diagnoses a refueling event when an engine is started. The refueling volume calculation module determines a refueling volume based on a difference between a first fuel volume measured before the refueling event and a second fuel volume measured after the refueling event. The canister loading module determines a canister loading value based on the refueling volume, wherein the canister loading value corresponds to a ratio of a volume of a vapor canister to a volume of fuel vapor within the vapor canister. The purge adjustment module adjusts a fuel purge rate from the vapor canister based on the canister loading value.

16 Claims, 4 Drawing Sheets

EVAPORATIVE EMISSIONS PURGE CONTROL

CROSS-REFERENCE TO RELATED APPLICATIONS

This application claims the benefit of U.S. Provisional Application No. 60/990,465, filed on Nov. 27, 2007. The disclosure of the above application is incorporated herein by reference in its entirety.

FIELD

The present disclosure relates to vehicle emissions and more particularly to evaporative emissions control.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Referring now to FIG. 1, a functional block diagram of an engine system 100 is presented. Air is drawn into an engine 102 through an intake manifold 104. The volume of air drawn into the engine 102 is varied by a throttle valve 106, which is actuated by an electronic throttle control (ETC) motor 108. The air mixes with fuel from one or more fuel injectors, such as the fuel injector 110, to form an air/fuel (A/F) mixture. The A/F mixture is combusted within one or more cylinders 112 of the engine 102 to generate torque. For example only, combustion may be initiated by spark from a spark plug 114. Resulting gas is expelled from the engine 102 to an exhaust system 115.

The fuel is stored in a fuel tank 116 prior to being brought to the engine 102 to be combusted. A modular reservoir assembly (MRA) 118 is disposed within the fuel tank 116 and includes a fuel pump 120. The fuel pump 120 provides fuel to the fuel injectors via a fuel rail 122. The fuel is filled into the fuel tank 116 through an inlet 124. A fuel cap 126 seals the inlet 124 and the fuel tank 116.

Fuel vapor may accumulate in the fuel tank 116 for various reasons, such as heat, radiation, and/or vibration. Fuel vapor travels from the fuel tank 116 through a vapor line 128 to a vapor canister 130, which stores the fuel vapor. The canister 130 may include, for example, an active charcoal that absorbs the fuel vapor. The canister 130 may also include a vent valve 132, which may be actuated to allow air into the canister 130.

The operation of the engine 102 creates a vacuum within the intake manifold 104. A second vapor line 134 connects the canister 130 to the intake manifold 104 via a purge valve 136. The purge valve 136 is actuated to draw (purge) the stored fuel vapor, from the canister 130, into the intake manifold 104. This fuel vapor forms part of the A/F mixture and may be combusted within the cylinders.

SUMMARY

A fuel vapor control module for a vehicle comprises a refill diagnostic module, a refill volume calculation module, a canister loading module, and a purge adjustment module. The refill diagnostic module diagnoses a refueling event when an engine is started. The refueling volume calculation module determines a refueling volume based on a difference between a first fuel volume measured before the refueling event and a second fuel volume measured after the refueling event. The canister loading module determines a canister loading value based on the refueling volume, wherein the canister loading value corresponds to a ratio of a volume of a vapor canister to a volume of fuel vapor within the vapor canister. The purge adjustment module adjusts a fuel purge rate from the vapor canister based on the canister loading value.

In other features, the purge adjustment module adjusts the fuel purge rate to a predetermined rate when the engine is started. In further features, the canister loading module determines the canister loading value based on the refueling volume, the predetermined rate, a signal indicating oxygen measured in an exhaust system of a vehicle, and a previous canister loading value determined before the refueling event.

In still further features, the canister loading module determines the canister loading value based on the previous canister loading value when the refueling event has not occurred. The refueling diagnostic module diagnoses the refueling event when the second fuel volume is greater than the first fuel volume.

In still other features, the refueling diagnostic module diagnoses the refueling event when the second fuel volume is greater than the first fuel volume and a first tank pressure is less than a second tank pressure, wherein the first tank pressure is measured before the refueling event and the second tank pressure is measured after the refueling event. The purge adjustment module adjusts the fuel purge rate by adjusting a duty cycle at which a purge valve is actuated. A vapor control system comprises the fuel vapor control module, the vapor canister, and a purge valve. The purge valve is actuated to purge the fuel vapor from the vapor canister to the engine at the fuel purge rate.

A method comprises diagnosing a refueling event when an engine is started in a vehicle, determining a refueling volume based on a difference between a first fuel volume measured before the refueling event and a second fuel volume measured after the refueling event, determining a canister loading value based on the refueling volume, wherein the canister loading value corresponds to a ratio of a volume of a vapor canister to a volume of fuel vapor within the vapor canister, and adjusting a fuel purge rate from the vapor canister based on the canister loading value.

In other features, the method further comprises adjusting the fuel purge rate to a predetermined rate when the engine is started. In further features, the canister loading value is determined based on the refueling volume, the predetermined rate, a signal indicating oxygen measured in an exhaust system of a vehicle, and a previous canister loading value determined before the refueling event.

In still other features, the canister loading value is determined based on the previous canister loading value when the refueling event has not occurred. In further features, the refueling event is diagnosed when the second fuel volume is greater than the first fuel volume. In still further features, the refueling event is diagnosed when the second fuel volume is greater than the first fuel volume and a first tank pressure is less than a second tank pressure, wherein the first tank pressure is measured before the refueling event and the second tank pressure is measured after the refueling event.

In other features, the adjusting the fuel purge rate comprises adjusting a duty cycle at which a purge valve is actuated. In further features, the method further comprises actuating a purge valve to purge the fuel vapor from the vapor canister to the engine at the fuel purge rate.

Further areas of applicability of the present disclosure will become apparent from the detailed description provided hereinafter. It should be understood that the detailed description and specific examples, while indicating the preferred embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
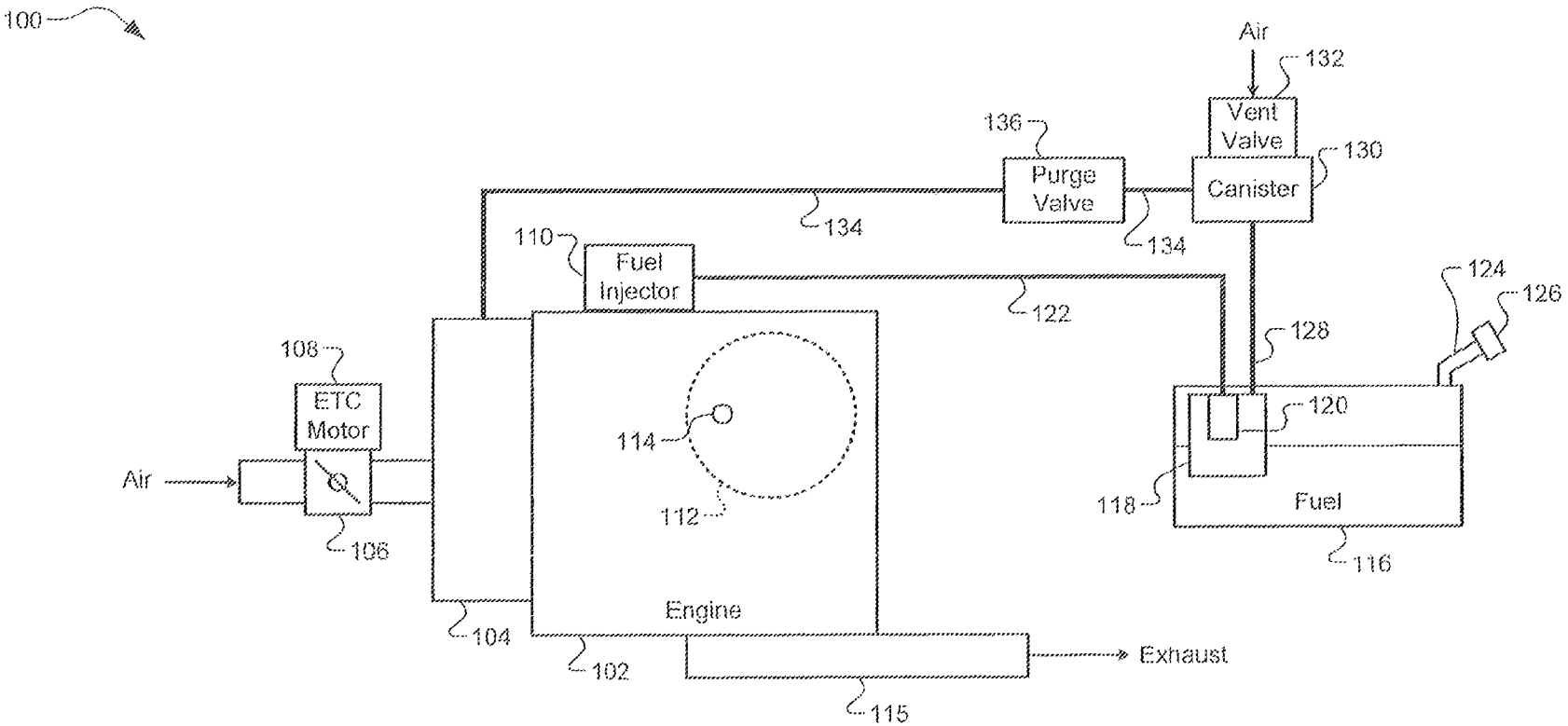
FIG. 1 Prior Art
FIG. 1 is a functional block diagram of an engine system according to the prior art.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

A purge valve is actuated to draw (purge) fuel vapor from a vapor canister. This purged fuel vapor increases fuel content of an A/F mixture that is combusted within an engine. A purge controller regulates the rate at which the vapor is purged from the vapor canister (fuel purge rate). More specifically, the purge controller controls the duty cycle at which the purge valve is actuated, i.e., the percentage of a period of time that the purge valve is open.

During normal engine operation, the purge controller determines how much of the vapor canister is occupied by fuel vapor (canister loading) based on feedback from an oxygen sensor. Additionally, the canister loading may also be determined based on the duty cycle. The purge controller adjusts the duty cycle to provide a desired A/F mixture, such as a stoichiometric mixture.

Generally, the canister loading when an engine is started is approximately the same as when the engine was shut down. Accordingly, when the engine is started, the purge controller may generally assume that the canister loading is the same as it was when the engine was shut down. However, the canister loading may be increased after engine shutdown by, for example, filling fuel into a fuel tank (refueling). Accordingly, when the engine is started, the purge controller determines whether a refueling event has occurred. If so, the purge controller determines a current canister loading, and adjusts the duty cycle, and therefore the fuel purge rate, based upon this current canister loading.

Figure 2:
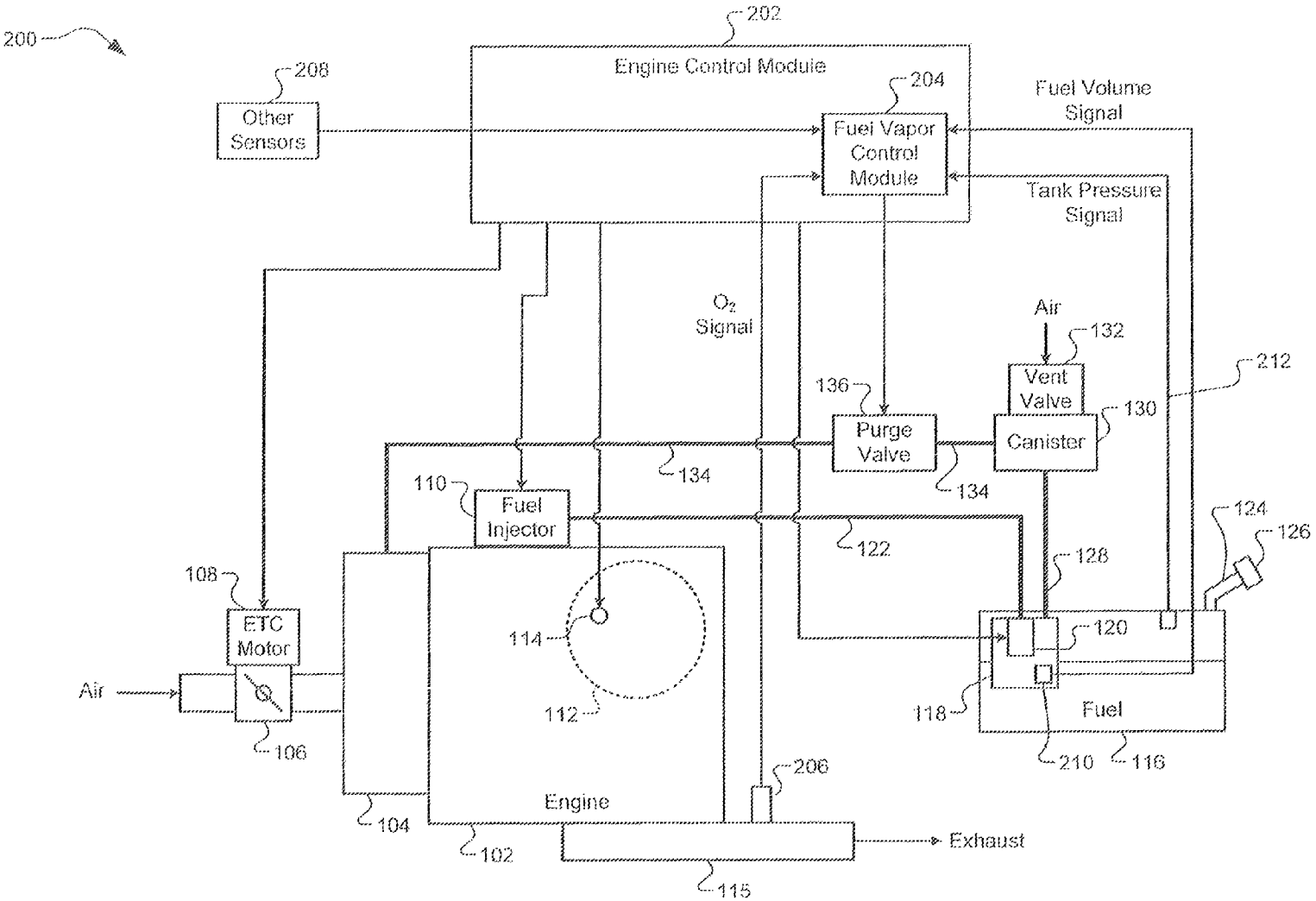
FIG. 2 is a functional block diagram of an exemplary engine system according to the principles of the present disclosure.

Referring now to FIG. 2, a functional block diagram of an exemplary engine system 200 is presented. The engine 102 combusts an A/F mixture within one or more cylinders 112 of the engine 102 to produce torque. The engine 102 may be any suitable type of internal combustion engine, such as a spark-ignition type engine, a compression-combustion type engine, and/or a hybrid-type engine. While the engine 102 may include multiple cylinders, for illustration purposes, a single representative cylinder 112 is shown. For example only, the engine 102 may include 2, 3, 4, 5, 6, 8, 10, or 12 cylinders. In various implementations, one fuel injector 110 may be provided for each of the cylinders.

An engine control module (ECM) 202 controls the A/F mixture via the throttle valve 106 and/or the fuel injectors. The ECM 202 includes a fuel vapor control module 204 that generates a purge signal, which controls the duty cycle at which the purge valve 136 is actuated. For example only, the duty cycle may be a percentage of a period of time that the purge valve 136 is open. Accordingly, the fuel vapor control module 204, via the purge signal, controls the rate at which the fuel vapor is purged from the canister 130. This rate will be referred to as the fuel purge rate. Discussion of controlling the duty cycle may be found in commonly assigned U.S. patent application Ser. No. 11/668,888, filed Jan. 30, 2007, the disclosure of which is incorporated herein by reference in its entirety.

An oxygen sensor 206 measures oxygen concentration in the exhaust system 115 and outputs an oxygen (O2) signal that corresponds to the measured oxygen concentration. The fuel vapor control module 204 controls the duty cycle based upon the output of the oxygen sensor 206. For example only, the fuel vapor control module 204 may decrease the duty cycle as the oxygen concentration decreases (i.e., rich A/F mixture). In this manner, the fuel vapor control module 204 may decrease the fuel purge rate as the oxygen concentration decreases.

The fuel vapor control module 204 may also adjust the duty cycle based upon signals from other sensors 208. The other sensors 208 may include an engine speed sensor, a manifold absolute pressure (MAP) sensor, a mass air flow (MAF) sensor, and/or any other suitable sensor. For example only, the fuel vapor control module 204 may decrease the duty cycle as the MAP decreases. This may be done to prevent too much vapor from being purged (vacuumed) from the canister 130 by lower pressures within the intake manifold 104.

During engine operation, the temperature of the fuel stored in the fuel tank 116 may increase. This temperature increase may be caused by, for example, environmental radiation, heat from a road surface, heat from the exhaust system 115, and/or any other heat source. As time passes after engine shutdown, the temperature of the stored fuel may decrease. This decrease in temperature may create a natural vacuum within the fuel tank 116 (i.e., tank pressure less than ambient pressure) after engine shutdown.

The fuel vapor control module 204 adjusts the duty cycle to a predetermined duty cycle and determines whether a refueling event has occurred when the engine 102 is started. The predetermined duty cycle may be calibratable and may be set to avoid purging a large amount of fuel vapor. In various implementations, engine startup corresponds to a time when a driver inputs an instruction to activate the engine 102, such as turning a key "ON" or pressing a button.

The fuel vapor control module 204 may determine whether a refueling event has occurred in any suitable manner. For example only, the fuel vapor control module 204 may determine whether a refueling event has occurred based upon a fuel volume signal from a fuel volume sensor 210 and/or a tank pressure signal from a tank pressure sensor 212. The fuel volume signal and the tank pressure signal indicate a fuel volume and a tank pressure, respectively.

A refueling event increases the fuel volume. Accordingly, it is likely that a refueling event has occurred if the fuel volume at engine startup is started is greater than a previous fuel volume, such as a fuel volume at engine shutdown. In various implementations, engine shutdown corresponds to a time when a driver inputs an instruction to deactivate the engine 102, such as turning a key "OFF" or pressing a button.

The increase in fuel volume that is present when a refueling event takes place displaces gasses within the fuel tank 116, such as fuel vapor and/or oxygen, thereby compressing the gasses. Accordingly, it is likely that a fuel refill has occurred when the tank pressure at engine startup is greater than a previous tank pressure, such as a tank pressure at engine shutdown. For example only, the fuel vapor control module 204 may detect the occurrence of a refueling event when the fuel volume and the tank pressure are greater than a previous fuel volume and a previous tank pressure, respectively. In other implementations, the fuel vapor control module 204 may detect a refueling event when the natural vacuum is released by, for example, opening the fuel cap 126.

When a refueling event has been detected, the fuel vapor control module 204 determines a current canister loading and generates duty cycle based upon the current canister loading. The current canister loading may correspond to a percentage of the volume of the canister 130 that is occupied by fuel vapor. The fuel vapor control module 204 may determine the current canister loading based upon volume of the refueling event, a previous canister loading, and/or a canister loading factor.

For example, the volume of the refueling event may be the difference between the fuel volume (at engine startup) and the previous fuel volume, such as the fuel volume at engine shutdown. The fuel vapor control module 204 may determine the canister loading factor after engine startup. For example only, the canister loading factor may be determined based upon the predetermined duty cycle and the output of the oxygen sensor 206. For example only, at the predetermined duty cycle, the canister loading factor may increase as the oxygen signal decreases (i.e., less oxygen present in the exhaust). The previous canister loading may be a canister loading at a time at or before engine shutdown.

Figure 3:
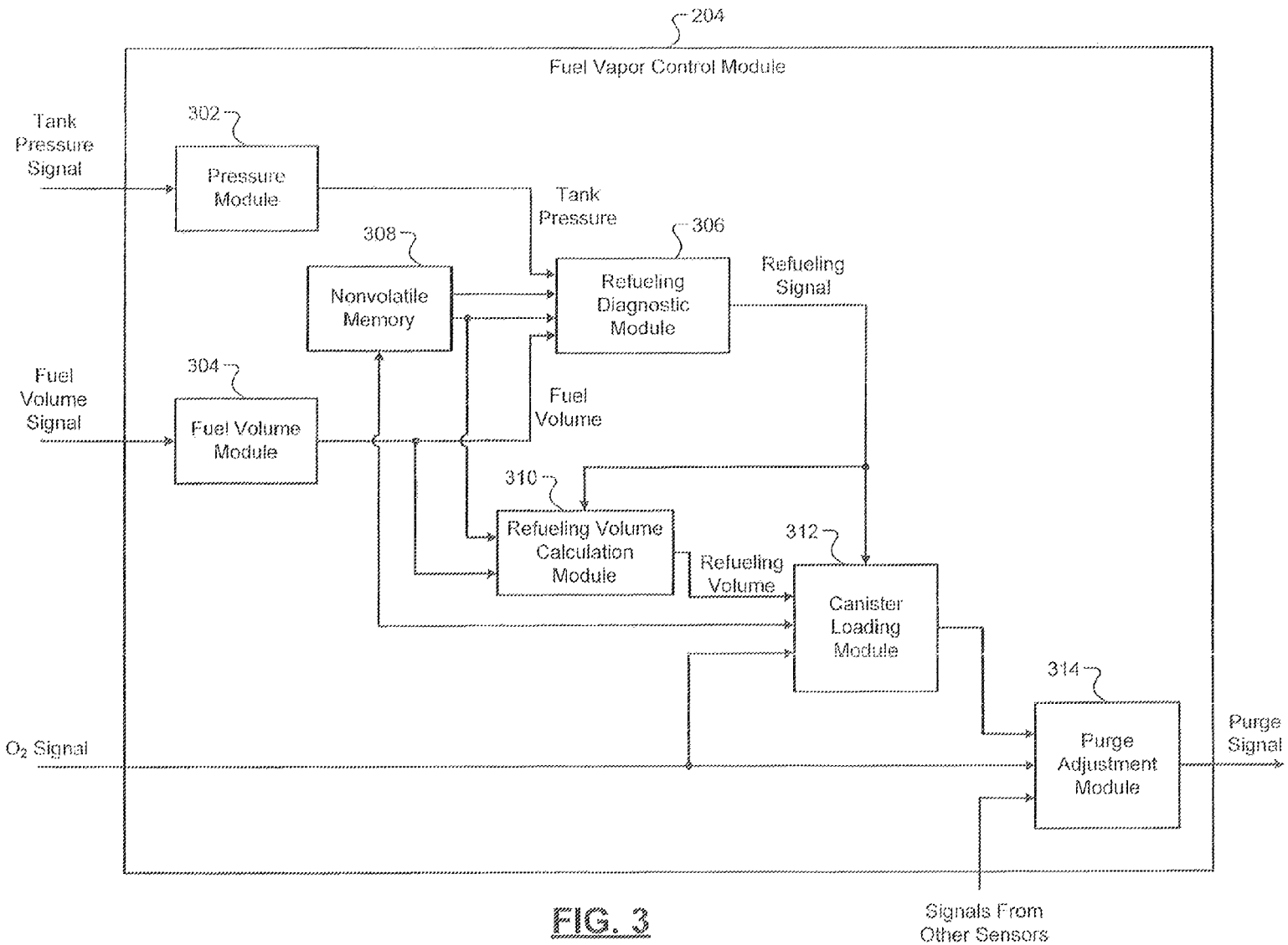
FIG. 3 is a functional block diagram of an exemplary fuel vapor control module according to the principles of the present disclosure.

Referring now to FIG. 3, a functional block diagram of an exemplary implementation of the fuel vapor control module 204 is presented. A pressure module 302 receives the tank pressure signal from the fuel tank pressure sensor 212. The pressure module 302 provides a tank pressure based upon the tank pressure signal. The pressure module 302 may, for example, filter, buffer, sample, and/or digitize the tank pressure signal. A fuel volume module 304 receives the fuel volume signal from the fuel volume sensor 210 and may, for example, filter, buffer, sample, or digitize the fuel volume signal. The fuel volume module 304 provides a fuel volume based upon the fuel volume signal.

A refueling diagnostic module 306 determines whether a refueling event has occurred and generates a refueling signal based upon this determination. Accordingly, the refueling signal indicates whether a refueling event has occurred. In various implementations, the refueling diagnostic module 306 determines whether a refueling event has occurred based upon the tank pressure and the fuel volume.

The refueling diagnostic module 306 may compare the fuel volume and the tank pressure with a previous fuel volume and a previous tank pressure, respectively. In various implementations, the previous fuel volume and the previous tank pressure may be stored in, for example, nonvolatile memory 308 and may be values from a time before, at, or after engine shutdown. For example only, the refueling diagnostic module 308 may indicate, via the refueling signal, that a refueling event has occurred when the tank pressure is greater than the previous tank pressure and the fuel volume is greater than the previous fuel volume. Alternatively, the refueling diagnostic module 306 may detect a refueling event in any suitable manner, such as when the fuel cap 126 is removed. In various implementations, a refueling event may be detected by another component of the engine system 200, and the fuel vapor control module 204 may be provided with an indication of a detected refueling event.

To determine that a refueling event has occurred, the refueling diagnostic module 308 may also require that the tank pressure and/or the fuel volume be greater than the previous tank pressure and fuel volume, respectively, by more than a predetermined percentage. This percentage may be calibratable and may be calculated to offset any coincidental increases in tank pressure and/or fuel volume that may be experienced. For example, external heat may cause the tank pressure to increase after engine shutdown. Additionally, the fuel volume may be artificially increased by, for example, movement of the fuel tank 116.

A refueling volume calculation module 310 receives the refueling signal and calculates the refueling volume when a refueling event has occurred. The refueling volume calculation module 310 may determine refueling volume based upon the fuel volume and the previous fuel volume. For example only, the refueling volume may the difference between the fuel volume and the previous fuel volume.

A canister loading module 312 determines the canister loading and provides the canister loading to a purge adjustment module 314. The canister loading may correspond to a ratio of the volume of the fuel vapor within the canister 130 to a volume of the canister 130. In other words, the canister loading may correspond to a volume of the canister 130 that is occupied by fuel vapor. Upon engine startup, the purge adjustment module 314 generates a predetermined purge signal. The predetermined purge signal may be calibrated to actuate the purge valve 138 at a predetermined duty cycle. This predetermined duty cycle may be calibrated to prevent unknowingly purging too much fuel vapor from the canister 130 when the engine 102 is started.

The canister loading module 312 receives the refueling signal, indicating whether a refueling event has occurred. When the refueling signal indicates that a refueling event has not occurred, the canister loading module 312 sets the canister loading equal to the previous canister loading. The previous canister loading may stored in the nonvolatile memory 308 and may be a canister loading from, for example, engine shutdown.

When the refueling signal indicates that a refueling event has occurred, the canister loading module 312 determines a current canister loading and sets the canister loading equal to the current canister loading. The current canister loading may be determined based upon the volume of the refueling event, the previous canister loading, and a canister loading factor.

In various implementations, the canister loading module 312 may learn the canister loading factor after the engine 102 is started. More specifically, the canister loading module 312 may determine the canister loading factor based upon the predetermined duty cycle and the oxygen signal from the oxygen sensor 206. For example only, the current canister loading may be determined using the equation: Current Canister Loading=(Refueling Volume*Canister Loading Factor)+Previous Canister Loading.

The canister loading module 312, as stated above, sets the canister loading equal to the current canister loading. In this manner, the canister loading module 312 updates the canister loading. The canister loading module 312 provides the (updated) canister loading to the purge adjustment module 314. The purge adjustment module 314 then adjusts the duty cycle, and therefore the fuel purge rate, based upon this canister loading. With knowledge of this increased canister loading, the purge adjustment module 314 may accurately control the duty cycle and the purge flow rate.

Figure 4:
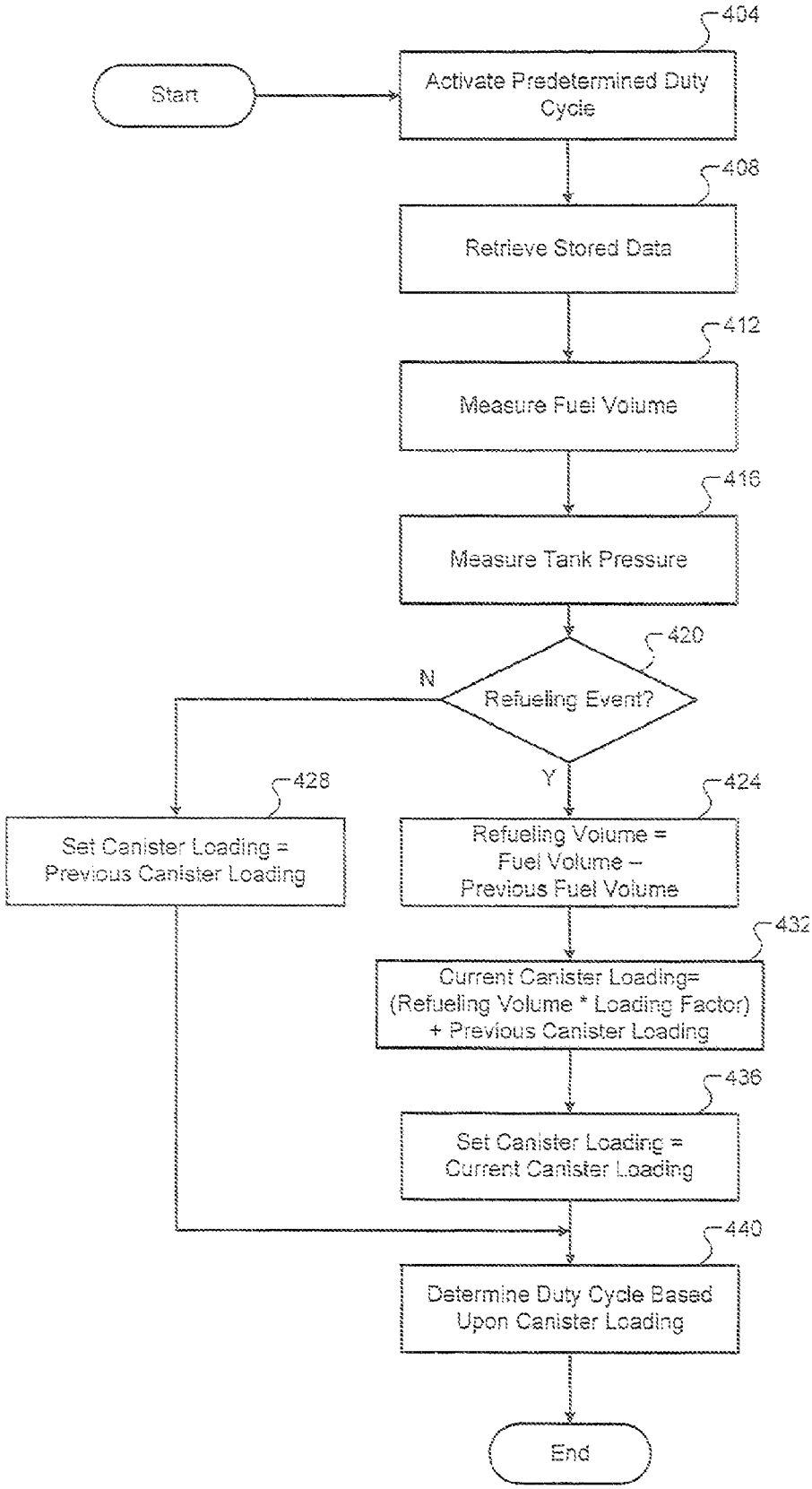
FIG. 4 is a flowchart depicting exemplary steps performed by the fuel vapor control module according to the principles of the present disclosure.

Referring now to FIG. 4, a functional block diagram depicting exemplary steps performed by the fuel vapor control module 204 is presented. Control begins upon engine startup in step 404 and control activates a predetermined duty cycle. Control then continues in step 408 where control retrieves the stored data. For example only, the stored data may include the previous fuel volume, the previous tank pressure, and/or the previous canister loading. These values may be retrieved from, for example, the nonvolatile memory 308.

Control continues in step 412 where control measures the fuel volume. In step 416 control measures the tank pressure. Control then continues in step 420, where control determines whether a refueling event has occurred. If so, control continues in step 424; otherwise, control transfers to step 428. In step 424, control determines the volume of the refueling event (i.e., the refueling volume). For example only, the refueling volume may be determined by calculating the difference between the measured fuel volume and the previous fuel volume.

Control then continues in step 432, where control determines the current canister loading. Control may determine the current canister loading based upon the refueling volume, the previous canister loading, and the canister loading factor. The canister loading factor may be determined based upon the predetermined duty cycle and the output of the oxygen sensor 206. For example only, control may calculate the current canister loading using the equation:

Current Canister Loading=(Refueling Volume*Canister Loading Factor)+Previous Canister Loading.

Control then continues in step 436, where control sets the canister loading equal to the current canister loading. In this manner, control updates the canister loading to reflect the additional canister loading provided by the refueling event. Control continues to step 440, where control determines a duty cycle based upon the canister loading. More specifically, control generates the purge signal that corresponds to the duty cycle. This duty cycle corresponds to a fuel purge rate. In this manner, control adjusts the fuel purge rate based upon the current canister loading. Control then ends.

Returning to step 428 (i.e., when a refueling event is not detected), control sets the canister loading equal to the previous canister loading. In this manner control updates the canister loading based upon the canister loading at, for example, engine shutdown. Control then continues to step 440. In this manner, control determines the duty cycle based upon the previous canister loading when a refueling event is not detected.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A fuel vapor control module for a vehicle, comprising:

a refill diagnostic module that diagnoses a refueling event when an engine is started;

a refueling volume calculation module that determines a refueling volume based on a difference between a first fuel volume measured before said refueling event and a second fuel volume measured after said refueling event;

a canister loading module that determines a canister loading value based on said refueling volume, wherein said canister loading value corresponds to a ratio of a volume of a vapor canister to a volume of fuel vapor within said vapor canister; and a purge adjustment module that adjusts a fuel purge rate from said vapor canister based on said canister loading value.

2. The fuel vapor control module of claim 1 wherein said purge adjustment module adjusts said fuel purge rate to a predetermined rate when said engine is started.

3. The fuel vapor control module of claim 2 wherein said canister loading module determines said canister loading value based on said refueling volume, said predetermined rate, a signal indicating oxygen measured in an exhaust system of a vehicle, and a previous canister loading value determined before said refueling event.

4. The fuel vapor control module of claim 3 wherein said canister loading module determines said canister loading value based on said previous canister loading value when said refueling event has not occurred.

5. The fuel vapor control module of claim 1 wherein said refueling diagnostic module diagnoses said refueling event when said second fuel volume is greater than said first fuel volume.

6. The fuel vapor control module of claim 5 wherein said refueling diagnostic module diagnoses said refueling event when said second fuel volume is greater than said first fuel volume and a first tank pressure is less than a second tank pressure, wherein said first tank pressure is measured before said refueling event and said second tank pressure is measured after said refueling event.

7. The fuel vapor control module of claim 1 wherein purge adjustment module adjusts said fuel purge rate by adjusting a duty cycle at which a purge valve is actuated.

8. A vapor control system comprising:

a refill diagnostic module that diagnoses a refueling event when an engine is started;

a refueling volume calculation module that determines a refueling volume based on a difference between a first fuel volume measured before said refueling event and a second fuel volume measured after said refueling event;

a canister loading module that determines a canister loading value based on said refueling volume, wherein said canister loading value corresponds to a ratio of a volume of a vapor canister to a volume of fuel vapor within said vapor canister;

a purge adjustment module that adjusts a fuel purge rate from said vapor canister based on said canister loading value;

the vapor canister; and a purge valve that is actuated to purge said fuel vapor from said vapor canister to said engine at said fuel purge rate.

9. A method comprising:

diagnosing a refueling event when an engine is started in a vehicle;

determining a refueling volume based on a difference between a first fuel volume measured before said refueling event and a second fuel volume measured after said refueling event;

determining a canister loading value based on said refueling volume, wherein said canister loading value corresponds to a ratio of a volume of a vapor canister to a volume of fuel vapor within said vapor canister; and adjusting a fuel purge rate from said vapor canister based on said canister loading value.

10. The method of claim 9 further comprising adjusting said fuel purge rate to a predetermined rate when said engine is started.

11. The method of claim 10 wherein said canister loading value is determined based on said refueling volume, said predetermined rate, a signal indicating oxygen measured in an exhaust system of a vehicle, and a previous canister loading value determined before said refueling event.

12. The method of claim 11 wherein said canister loading value is determined based on said previous canister loading value when said refueling event has not occurred.

13. The method of claim 9 wherein said refueling event is diagnosed when said second fuel volume is greater than said first fuel volume.

14. The method of claim 13 wherein said refueling event is diagnosed when said second fuel volume is greater than said first fuel volume and a first tank pressure is less than a second tank pressure, wherein said first tank pressure is measured before said refueling event and said second tank pressure is measured after said refueling event.

15. The method of claim 9 wherein said adjusting said fuel purge rate comprises adjusting a duty cycle at which a purge valve is actuated.

16. The method of claim 9 further comprising actuating a purge valve to purge said fuel vapor from said vapor canister to said engine at said fuel purge rate.

* * * * *